US006123148A

United States Patent [19]

Oneal

[11] Patent Number: 6,123,148

[45] Date of Patent: Sep. 26, 2000

[54] COMPACT RETRIEVABLE WELL PACKER

[75] Inventor: Dean Oneal, Lafayette, La.

[73] Assignee: Halliburton Energy Services, Inc., Dallas, Tex.

[21] Appl. No.: 09/382,268

[22] Filed: Aug. 24, 1999

Related U.S. Application Data

[62] Division of application No. 08/976,624, Nov. 25, 1997, Pat. No. 5,988,276.

[51] Int. Cl.[7] ..... E21B 23/06

[52] U.S. Cl. ..... 166/118; 166/134; 166/196

[58] Field of Search ..... 166/72, 116, 118, 166/124, 134, 179, 196, 382, 387

[56] References Cited

U.S. PATENT DOCUMENTS

| | | | |
|---|---|---|---|
| 3,503,445 | 3/1970 | Cochrun et al. | 166/187 X |
| 3,529,665 | 9/1970 | Malone | 166/187 X |
| 3,530,934 | 9/1970 | Kisling | 166/134 |
| 3,554,280 | 1/1971 | Tucker | 166/134 |
| 3,575,237 | 4/1971 | Malone | 166/187 X |
| 3,575,238 | 4/1971 | Shillander | 166/187 X |
| 3,604,732 | 9/1971 | Malone | 166/187 X |
| 3,690,375 | 9/1972 | Shillander | 166/187 |
| 3,889,749 | 6/1975 | Hutchison | 166/187 |
| 4,253,676 | 3/1981 | Baker et al. | 166/187 X |
| 4,403,660 | 9/1983 | Coone . | |
| 4,979,570 | 12/1990 | Mody | 166/387 |
| 5,685,369 | 11/1997 | Ellis et al. | 166/195 |

FOREIGN PATENT DOCUMENTS

| | | | |
|---|---|---|---|
| 2312697 | 3/1997 | United Kingdom | E21B 33/12 |

OTHER PUBLICATIONS

UK Search Report for Application #GB 9825755.3.

*Primary Examiner*—Roger Schoeppel
*Attorney, Agent, or Firm*—Paul I. Herman; Marlin R. Smith

[57] ABSTRACT

A packer is provided which reduces the number of components required in a retrievable packer. The packer is compact in size, and convenient and economical in use. In a described embodiment, the packer includes seal carrying and gripping assemblies mounted on a mandrel. Axial compression of the assemblies causes a seal and grip structures carried on the assemblies to radially outwardly deflect. Each of the assemblies may be integrally formed, thereby further reducing the number of components needed to construct the packer. Each of the assemblies is usable separately on the mandrel to produce apparatus which only grippingly engage or only sealingly engage a tubular member in a well. The packer or similar apparatus is retrieved by releasing the force axially compressing the assemblies.

29 Claims, 5 Drawing Sheets

FIG. 1B
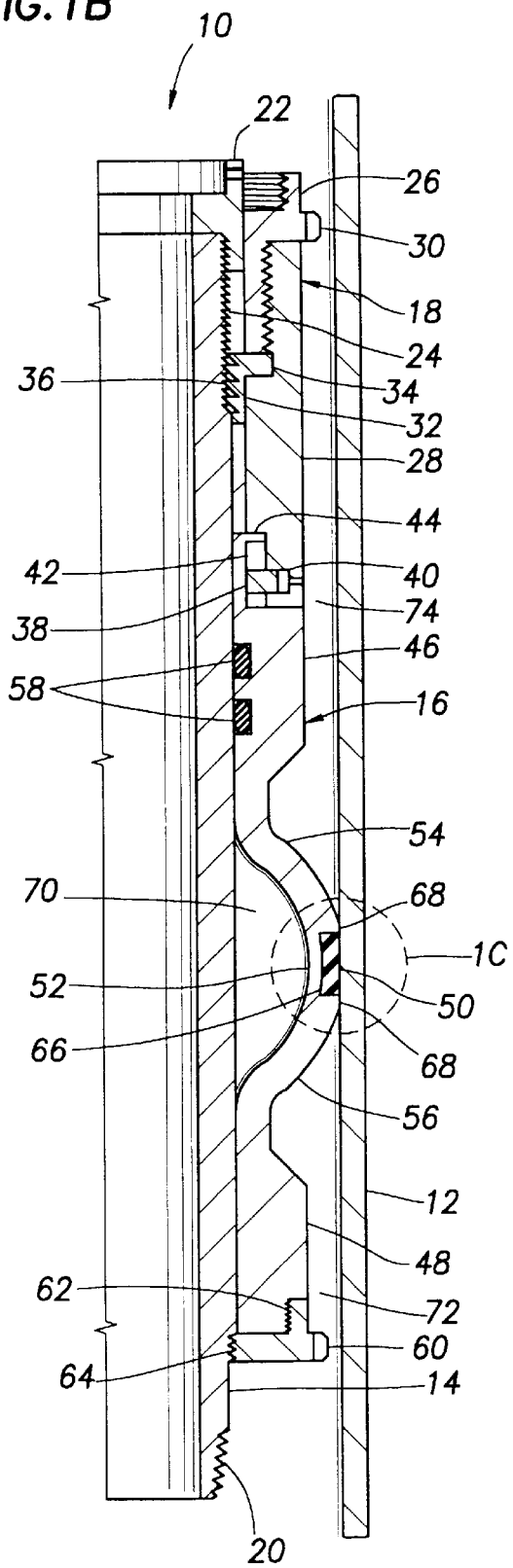
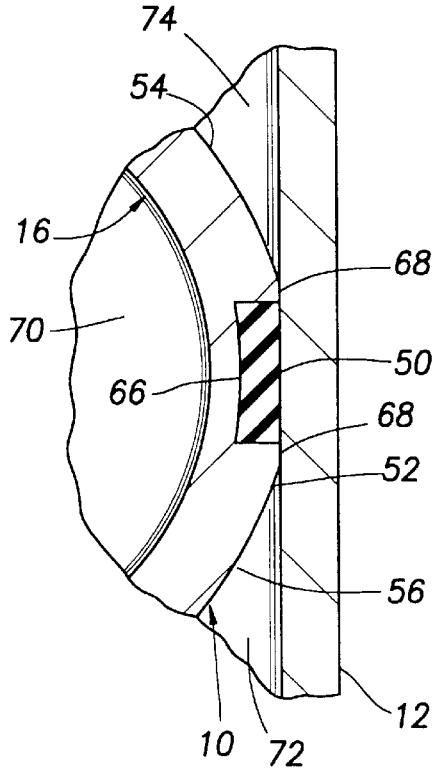
FIG. 1C

COMPACT RETRIEVABLE WELL PACKER

This is a division of application Ser. No. 08/976,624, filed Nov. 25, 1997, now U.S. Pat. No. 5,988,276, incorporated by reference herein in its entirety.

BACKGROUND OF THE INVENTION

The present invention relates generally to equipment utilized in subterranean wells and, in an embodiment described herein, more particularly provides a compact retrievable packer.

Packers are typically made up of a large number of components. Each of these components must be designed, tested, manufactured, inspected, inventoried, assembled with the other components, etc., in order to produce a certain type of packer for use in a particular size of casing or other tubular member in which the packer is to be set. As used herein, the term "set" is used to indicate that an apparatus has been operated to sealingly engage and grippingly engage a tubular member, or only sealingly engage or grippingly engage the tubular member if it is designed to perform one but not the other of those functions.

Unfortunately, due to the limitations of current packer designs, a packer is typically usable in only one or a few different weight ranges of a particular casing size. This is caused in part by the fact that a predetermined radial clearance exists between the outside diameter of the packer and the inside diameter of the particular casing size and weight. Thus, components designed for use in a packer in a particular size and weight of casing may not be usable in another packer in a different size or weight of casing and, therefore, these components must be designed, tested, manufactured, etc. for each packer and each size and weight range of casing.

Accordingly, it would be highly advantageous to provide a packer which includes a small number of components, and which is usable in a wide range of casing sizes and weights. This would greatly reduce the time and expense required for designing components for the packer, testing the packer, manufacturing, inspecting, shipping and warehousing the components, assembling the packer, etc. However, in order to achieve the objective of usability in a wide range of casing sizes and weights, the problem of variable radial clearance between the packer and casing inner diameter must be solved.

In the past, packers have typically been designed so that the radial clearance between the packer and a particular casing inner diameter is as small as possible, while still permitting the packer to be displaced through the casing. Unfortunately, due to tolerances in packer and casing manufacture, the presence of scale, corrosion, various contaminants, such as salt pills, adhered to the casing inner diameter, etc., the radial clearance must be comparatively large. This problem is compounded by the fact that the radial clearance is also an extrusion gap for seal elements carried on the packer, which must be radially outwardly extended to seal against the casing inner diameter.

When the seal elements are outwardly extended, they bridge the radial clearance and prevent fluid flow between the packer and the casing. Since fluid pressure applied to one side of the seal elements will cause them to extrude into the gap between the packer and casing on the other side, the radial clearance is also an extrusion gap. Failure of the seal elements to seal against fluid pressure is often caused by excessive extrusion of the seal elements into the extrusion gap.

In order to prevent such failure of the seal elements, various attempts have been made to minimize or eliminate the extrusion gap, or to increase resistance of the seal elements to such extrusion. For example, backup rings may be installed straddling the seal elements in an attempt to close up the extrusion gap, but this increases the number of packer components and does not increase the packer's usability in other casing sizes and weights. As another example, the seal elements may be made of exotic extrusion-resistant materials or provided with "garter springs" to increase extrusion resistance, but these increase the cost of the seal elements and still do not increase the packer's usability in other casing sizes and weights.

It would, therefore, also be highly advantageous to provide a packer which has the capability of closing off the extrusion gap, while still permitting sufficient radial clearance between the packer and a wide variety of casing sizes and weights during run-in and retrieval of the packer. It would be even more advantageous to provide such a packer which did not require additional components for closing off the extrusion gap, and which did not require the seal elements to be made of expensive materials or to include devices such as "garter springs" therein.

In general, the seal elements on a conventional packer are radially outwardly extended by axially compressing the seal elements between annular gauge rings or element retainers mounted on the packer. One or both of the gauge rings or element retainers is axially displaceable relative to the other one of them, in order to squeeze the seal elements between them. Achieving such displacement of the gauge rings or element retainers requires complex mechanisms and, since there are limitations on the amount of squeeze and radial extension available for a given set of seal elements, these vary depending upon the size and weight of the casing for which the packer has been designed.

Thus, it would also be advantageous to provide a packer which does not require complex mechanisms for axially compressing seal elements, and which does not require axial compression of its seal elements in order to radially outwardly extend the seal elements. In this manner, the packer would be usable in a wider range of casing sizes and weights, and the packer would be less expensive to design, manufacture, inventory, assemble, etc.

Since there are limitations on the amount of radial extension typically available from a given set of seal elements on a given packer, the packer is frequently designed with the seal elements having an outer diameter only slightly smaller than the inner diameter of the casing in which the packer is designed to be set. This situation may result in the seal elements being abraded, cut, eroded, or otherwise damaged while the packer is being conveyed into, and positioned within, the casing, although it is common practice for a set of gauge rings on the packer to have a slightly larger diameter than the seal elements.

It would, therefore, be advantageous to provide a packer which permits the seal element to spaced away from the casing inner diameter by a comparatively large clearance while conveying and positioning the packer within the casing, and yet the packer still having the capability to radially outwardly extend the seal element into sealing engagement with the casing and the capability to eliminate the extrusion gap between the packer and the casing. Such capabilities would be even more advantageous in applications in which the packer must pass through restricted diameters before being set in the casing, such as in "slim hole" applications in which the packer must pass through a relatively small diameter tubing string before being set in a larger diameter casing.

Conventional tools, such as packers, tubing hangers, etc., are commonly provided with components collectively referred to as "slips", which act to anchor the tools within casing or other tubular members. The ability of such a tool to resist forces applied thereto depends in large part upon the amount and distribution of gripping contact of the slips with the tubular member inner diameter. In addition, complex mechanisms are typically required to radially outwardly extend the slips, and to time the extension of the slips where it is desired to achieve a particular sequence of setting the tool. For example, it may be desired to have a lower set of slips grip the inner diameter, then for the seal elements to seal against the inner diameter, and then for an upper set of slips to grip the inner diameter.

Therefore, it would be advantageous to provide a tool which includes slips that uniformly grip the tubular member inner diameter, which have a large amount of gripping contact with the inner diameter, and which do not require complex mechanisms for achieving such gripping engagement. Furthermore, it would be advantageous to provide the tool having the capability of conveniently achieving a particular sequence of engagement with the inner diameter, without requiring additional components, complex mechanisms, etc.

Additionally, it would be advantageous to provide a packer which is conveniently retrievable, without requiring complex mechanisms for such retrieval. Furthermore, if conventional attempts to retrieve the packer are unsuccessful, it would be advantageous to be able to retrieve a significant portion of the packer before the packer is milled, thereby reducing the time required to mill the packer. Still further, if milling of the packer is necessary, it would be advantageous for a mechanism which releases the packer from engagement with the casing to be positioned near the top of the packer, so that the packer will be released most expeditiously.

It would also be advantageous to provide a packer which is of modular design. In this manner, greater or fewer seal elements, slips, etc. may be installed on the packer for use in different applications, such as low pressure or high pressure applications. This would reduce the amount of inventory necessary to provide for such different applications, while increasing the versatility of the packer.

From the foregoing, it can be seen that it would be quite desirable to provide a packer which has the above advantages, but which is still capable of withstanding relatively high pressures and forces applied thereto. Of course, these advantages would also be desirable in other tools, such as tubing hangers, etc. It is accordingly an object of the present invention to provide such a packer and such other tools.

SUMMARY OF THE INVENTION

In carrying out the principles of the present invention, in accordance with embodiments thereof described in further detail hereinbelow, packers and other tools are provided which include a circumferentially continuous extension assembly for radially outwardly extending into engagement with the inner diameter of a casing or other tubular member disposed within a well. In certain embodiments, the extension assembly is substantially completely integrally formed of a single piece of material, thereby greatly reducing the quantity, cost and size of components in the tool. Due to unique features of the tools, they are usable in a wide variety of tubular member inner diameters, and may be provided with comparatively large radial clearances.

In one aspect of the present invention, an extension assembly includes an external annular recess formed on an intermediate portion thereof and a seal disposed in the recess. When the extension assembly is axially compressed, the intermediate portion is displaced radially outward, carrying the seal therewith. Thus, the seal and the intermediate portion may engage a tubular member inner diameter, the seal sealing against the inner diameter and the intermediate portion eliminating the radial clearance between the extension assembly and the inner diameter. Additionally, the recess may be deformed to further urge the seal into sealing contact with the inner diameter.

In another aspect of the present invention, an extension assembly may include an outer gripping surface formed on an intermediate portion thereof and one or more grip structures attached to the gripping surface. These grip structures may take the form of teeth, serrations, slips, etc. formed on the gripping surface. When the extension assembly is axially compressed, the intermediate portion is displaced radially outward, thereby grippingly engaging the grip structures with the tubular member inner diameter. This extension assembly and the above-referenced seal carrying extension assembly may be configured to achieve a particular sequence of extension with only minimal modification to one or more of the extension assemblies, and without requiring any additional components.

In yet another aspect of the present invention, one or more of the extension assemblies may be mounted on a tubular mandrel, thereby producing a variety of tools, such as packers and tubing hangers. Additionally, the extension assemblies may be configured to permit use of the tool in slim hole or other special applications.

In still another aspect of the present invention, a release mechanism is provided which utilizes few components, but which is convenient and efficient in operation. If retrieval is unsuccessful, a significant portion of the release mechanism may be detached from the tool prior to milling the tool. The release mechanism is conveniently positioned near the top of the tool to expedite the milling operation.

In yet another aspect of the present invention, the extension assemblies are provided with extension members interconnecting the intermediate portion to end portions of the extension assemblies. The extension members axially and radially space the intermediate portion away from the end portions. Thus, the intermediate portion inner diameter is greater than the inner diameters of the end portions. In this manner, when the extension assembly is axially compressed, the extension members force the intermediate portion radially outward. The extension members may take any shape, such as curved or straight, between the end portions and the intermediate portion.

These and other features, advantages, benefits and objects of the present invention will become apparent to one of ordinary skill in the art upon careful consideration of the detailed description of representative embodiments of the invention hereinbelow and the accompanying drawings.

BRIEF DESCRIPTION OF THE DRAWINGS

FIGS. 1A–1C are cross-sectional views of a first tool embodying principles of the present invention, the tool being shown in a configuration in which it is run into a well in FIG. 1A, the tool being shown in a configuration in which it is set in a tubular member in FIG. 1B, and a detail of the set tool being shown in FIG. 1C;

DETAILED DESCRIPTION

In the following description of representative embodiments of the invention, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

Figure 1A:
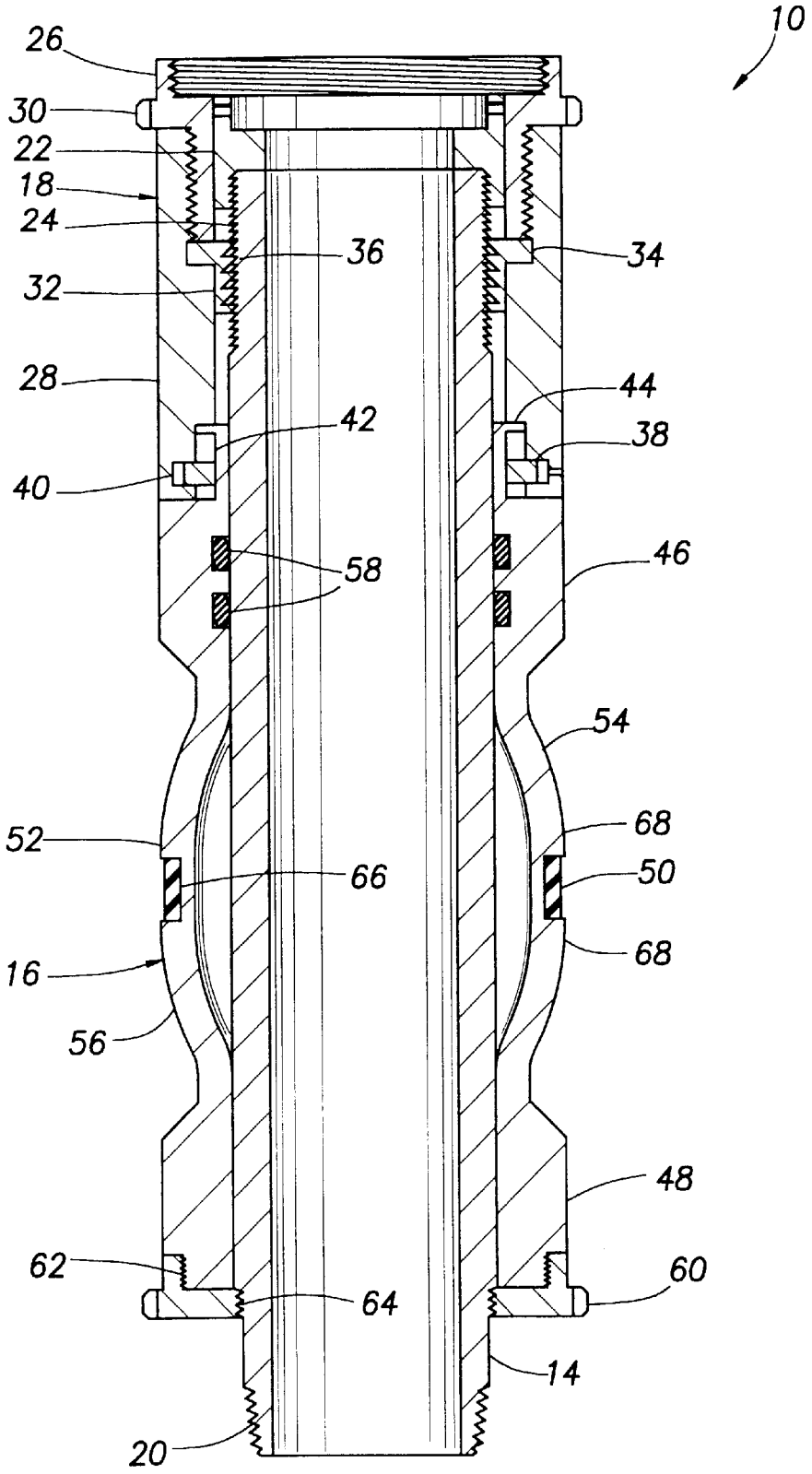

Representatively illustrated in FIGS. 1A–1C is a tool 10 which embodies principles of the present invention. The tool 10 may be referred to as a "slipless packer", since it is configured for sealing engagement within a casing 12 or other tubular member without also anchoring to the casing. However, the tool 10 may also, or alternatively, be provided with slips or other gripping members in a manner that will be more fully described hereinbelow.

The tool 10 includes a generally tubular mandrel 14, a generally tubular extension assembly 16, and a force transmitting assembly 18. The mandrel 14 is provided with threads 20 at its lower end for sealing attachment to a tubing string and/or other tools (not shown) therebelow. At its upper end, the mandrel 14 is provided with a shear pin collar 22 for releasable attachment to a conventional setting/retrieval service tool (see FIG. 4). For attachment of the shear pin collar 22 to the mandrel 14, relatively fine buttress-type threads or annular grooves 24 are formed externally on the upper end of the mandrel 14, which threads are also useful for maintaining a compressive force in the force transmitting assembly 18, in a manner that will be more fully described hereinbelow. However, it is to be clearly understood that it is not necessary for the mandrel 14 to have the shear pin collar 22 attached thereto, or for the shear pin collar to be attached utilizing relatively fine buttress-type threads. For example, the mandrel 14 could be provided with other threads, such as threads 20, for sealing attachment of the mandrel to a tubing string extending upwardly from the mandrel.

The force transmitting assembly 18 includes a generally tubular gauge ring sub 26 threadedly secured to a generally tubular compression member 28. The gauge ring sub 26 is configured for attachment to the setting/retrieval service tool referred to above. It includes a radially enlarged and externally scalloped portion 30 conventionally referred to as a gauge ring.

The gauge ring 30 approximately centers the tool 10 within the casing 12. Its externally scalloped surface enables fluid to easily flow between the tool 10 and the casing 12 before the tool is set therein. Of course, the gauge ring 30 may alternatively be provided with longitudinally drilled holes for this purpose. The gauge ring 30 also spaces the remainder of the tool 10 away from the casing 12, thereby reducing damage to the tool due to abrasion against the casing, etc. Different diameter gauge rings 30 may be provided for use with the tool 10 in different casing 12 sizes and weights. However, it is to be understood that the gauge ring 30 is not necessary in the tool 10 in keeping with the principles of the present invention.

When the setting/retrieval tool is operated to set the tool 10, an inner member of the setting/retrieval tool applies a tensile force to the shear pin collar 22 and an outer member of the setting/retrieval tool applies an equal and oppositely directed compressive force to the gauge ring sub 26. The tensile force is resisted by shear pins (not shown) installed through the shear pin sub and inner member of the setting/retrieval tool, and the compressive force is transmitted through the gauge ring sub 26 to the compression member. It is to be clearly understood, however, that the tool 10 may be set by other types of service tools, or by direct application of forces to the tool 10. For example, a tensile force could be applied to the mandrel 14 by a tubing string attached thereto as described above, by a wireline setting tool, etc.

A generally tubular internal slip member 32 is disposed between the compression member 28 and the mandrel 14. The slip member 32 may be circumferentially segmented, or may have a generally C-shaped cross-section, allowing the slip member to radially deflect somewhat relative to the mandrel 14. A radially enlarged portion 34 of the slip member is retained axially between the gauge ring sub 26 and the compression member 28.

When the axially compressive force is applied to the force transmitting assembly 18 to set the tool 10, the force transmitting assembly will displace downwardly relative to the mandrel 14. The slip member 32 is provided with internal buttress-type threads, teeth or grooves 36 which engage the threads/teeth/grooves 24 on the mandrel 14 to thereby prevent upward displacement of the force transmitting assembly 18 relative to the mandrel. Note that the threads 24 are inclined downwardly on one face of each, and the threads 36 are inclined upwardly on one face of each, so that the slip member 32 permits the threads 24, 36 to ramp over each other when the force transmitting assembly 18 is displaced downwardly relative to the mandrel 14, but the threads engage with each other to prevent upward displacement of the force transmitting assembly relative to the mandrel. Thus, the slip member 32 maintains the compressive force in the force transmitting assembly 18 until released in a manner more fully described hereinbelow.

As representatively illustrated in FIGS. 1A–1B, the threads 36 are somewhat coarser than the threads 24. In this manner, relatively small increments of displacement of the slip member 32 relative to the mandrel 14 may be easily resisted by engagement of the teeth 24, 36. However, it is to be clearly understood that such relationship between the threads 24, 36 is not necessary in keeping with the principles of the present invention. For example, it is not necessary for the threads 24 to be provided on the mandrel 14 at all, since the threads 36 may grippingly engage the surface of the mandrel. As another example, one or both of the threads 24, 36 may actually be teeth, serrations, or other gripping structure, instead of threads.

The force transmitting assembly 18 is releasably attached to the extension assembly 16 by means of a snap ring 38 having a generally C-shaped cross-section. The snap ring 38 is received in an annular recess 40 internally formed on a lower end of the compression member 28, and in an annular recess 42 externally formed on an upper end of the extension assembly 16. In a manner that will be more fully described hereinbelow, the compression member 28 may be detached from the extension assembly 16 by upwardly displacing the compression member relative to the extension assembly until the snap ring 38 contacts a radially enlarged portion 44 of the extension assembly adjacent the recess 42, and then applying sufficient axially upwardly directed force to the compression member to shear the portion 44 from the extension assembly.

Note that in FIG. 1A, the recess 42 is depicted as having an outer diameter of approximately the same size as an inner diameter of the compression member 28. In order to prevent shearing of the portion 44 due to an axially downwardly directed force applied to the compression member 28, the recess 42 may actually have an outer diameter greater than the inner diameter of the compression member.

The extension assembly 16 includes a generally tubular upper end portion 46, a generally tubular lower end portion 48, a circumferential seal member 50, a seal carrying generally tubular intermediate portion 52, an upper extension member 54, a lower extension member 56, and internal circumferential seals 58. Since the extension assembly 16 is used to sealingly engage the interior of the casing 12, it may also be referred to as a packing assembly.

The seals 58 sealingly engage the mandrel 14 adjacent the upper end portion 46, but they may be otherwise positioned. For example, the seals 58 could sealingly engage the mandrel 14 adjacent the lower end portion 48 with appropriate modification to the lower end portion.

Note that the intermediate portion 52 has an inner circumference greater than that of either of the end portions 46, 48. Additionally, note that the intermediate portion 52 is radially spaced apart from the mandrel 14 by a radial distance greater than that between either of the end portions 46, 48 and the mandrel. It will be readily appreciated by a person of ordinary skill in the art that if one or both of the end portions 46, 48 is displaced axially toward the other one of them, such configuration will result in the intermediate portion 52 being radially outwardly deflected relative to the mandrel, the radial distance therebetween increasing accordingly.

The upper and lower extension members 54, 56 have a somewhat curved shape as representatively depicted in FIG. 1A. This shape imparts a smooth transition between each of the extension members 54, 56 and its respective end is portion 46, 48, and between each extension member and the intermediate portion 52. In this manner, stresses in the extension assembly 16 are reduced when the extension assembly is axially compressed. However, it is to be clearly understood that the extension members 54, 56 may be otherwise shaped without departing from the principles of the present invention. For example, the extension members 54, 56 or either of them may have a linear cross-section, producing extension members that have hollow conical forms, etc.

The lower end portion 48 is secured to the mandrel 14 by means of another gauge ring sub 60. The gauge ring sub 60 is somewhat similar to the previously described gauge ring sub 26. However, the gauge ring sub 60 is provided with threads 62, 64 for releasably attaching the lower end portion 48 to the mandrel 14. It is to be understood that it is not necessary for the lower end portion 48 to be threadedly attached to the mandrel 14. For example, the lower end portion 48 could be shear pinned or welded to the mandrel, or otherwise prevented from displacing relative thereto.

Preferably, the threads 64 are provided as left-handed threads and the remainder of the threads on the tool 10 are provided as right-handed threads. In this manner, if the tool 10 must be milled, right-hand rotation of a mill biting into the tool will not cause rotation of the force transmitting assembly 18 and/or extension assembly 16 with the mill. It is to be understood, however, that any of the tool 10 threads may be right- or left-handed, or may simply be annular grooves, etc., without departing from the principles of the present invention.

The seal 50 is installed in an annular recess 66 formed externally on the intermediate portion 52. Preferably, the seal 50 is molded within the recess 66, in order to prevent the seal from being washed out of the recess, but the seal could be separately installed in the recess. Seal support surfaces 68 axially straddle the seal 50 on the outer side surface of the intermediate portion 52. In a manner that will be more fully described hereinbelow, the seal support surfaces 68 are radially outwardly extended into contact with the casing 12 when the extension assembly 16 is axially compressed.

The seal 50 is depicted in FIG. 1A as a single circumferentially extending seal member. However, the seal 50 may alternatively be a set of seal elements, may include devices, such as backup rings, etc., and may be otherwise configured without departing from the principles of the present invention.

Note that, as representatively illustrated in FIG. 1A, the seal 50 is radially inwardly recessed relative to the seal support surfaces 68. This configuration reduces the possibility that the seal 50 will be abraded, cut, eroded, or otherwise damaged during conveyance and positioning of the tool 10 within the well. It is to be understood, however, that it is not necessary for the seal 50 to be recessed relative to the seal support surfaces 68, and that the seal 50 may be aligned with the surfaces or radially outwardly disposed relative to the surfaces without departing from the principles of the present invention.

Referring specifically now to FIG. 1B, the tool 10 is representatively depicted in a configuration in which it has been set within the casing 12. The seal 50 sealingly engages the casing 12 and, in combination with the seals 58, prevents flow of fluid between the mandrel 14 and the casing 12. The tool 10 has been set in the casing 12, for example, by applying an axially downwardly directed compressive force to the force transmitting assembly 18 via the gauge ring sub 26, while applying an axially upwardly directed tensile force to the mandrel 14 via the shear pin collar 22, utilizing the setting/retrieval service tool. After setting the tool 10, the setting/retrieval tool is detached from the tool 10 by shearing the shear pins installed through the shear pin collar 22.

The force transmitting assembly 18 has thus been downwardly displaced relative to the mandrel 14. The slip member 32 prevents subsequent upward displacement of the force transmitting assembly 18 relative to the mandrel 14, thus preventing unsetting of the tool 10 and maintaining the axially compressive force in the force transmitting assembly applied to the extension assembly 16 and resisted by the lower gauge ring sub 60. If it is desired to unset the tool 10, for example, to retrieve the tool to the earth's surface, the setting/retrieval tool may be attached to the upper gauge ring sub 26 and an axially upwardly directed tensile force applied thereto. When a sufficient tensile force has been applied to the upper gauge ring sub 26, the radially enlarged portion 34 will shear off of the remainder of the slip member 32, thereby releasing the compressive force and permitting the force transmitting assembly 18 to displace axially upward somewhat relative to the mandrel 14.

At this point, if the radially enlarged portion 34 has been sheared off of the slip member 32, the extension assembly 16 will axially extend somewhat due to its retained elasticity, even though portions thereof may have yielded when the extension assembly was axially compressed. The extension assembly 16 thus "springs back" somewhat, permitting the intermediate portion 52 to radially inwardly retract out of engagement with the casing 12. However, the extension assembly 16 remains attached to the force transmitting assembly 18 and a tensile force may be applied to the force transmitting assembly using the setting/retrieval tool to thereby aid in retraction of the extension assembly in the event that the extension assembly does not sufficiently spring back out of engagement with the casing 12.

The possibility remains that, for whatever reason, the tool 10 cannot be retrieved intact from within the casing 12. In that case, a significant portion of the tool 10 may be retrieved by applying an even greater tensile force to the upper gauge ring sub 26, after the portion 34 has been sheared off of the slip member 32 as described above. When a sufficient tensile force has been applied to the upper gauge ring sub 26, the portion 44 will be sheared off of the upper end portion 46, thereby permitting the upper gauge ring sub 26, compression member 28, snap ring 38 and portions 34, 44 to be retrieved to the earth's surface apart from the remainder of the tool 10. This leaves significantly fewer components of the tool 10 to be milled, thereby speeding the milling operation.

If, for whatever reason, the tool 10 may not be properly unset or it is not desired or possible to retrieve components of the tool 10 from the well prior to the milling operation as described above, the milling operation may nonetheless be expedited by the fact that the components maintaining the compressive force in the extension assembly 16 are positioned near the top of the tool. Thus, when the tool 10 is milled, these components will be cut through during initial milling, and the tool may become disengaged from the casing 12 without the remainder of the tool needing to be milled. The tool 10 may then be retrieved using conventional fishing tools and techniques.

Note that the extension members 54, 56 have radially outwardly deflected at ends thereof attached to the intermediate portion 52, and have not radially deflected at ends thereof attached to the end portions 46, 48. This outward deflection is due to the fact that each of the extension members 54, 56 has a circumference at its attachment to the respective end portion 46 or 48 that is less than its circumference at its attachment to the intermediate portion 52. Thus, when the extension assembly 16 is axially compressed, the extension members 54, 56 act as lever arms to force the intermediate portion 52 radially outward. Conversely, when the extension assembly 16 is axially extended, such as when the tool 10 is unset, the extension members 54, 56 radially inwardly retract the intermediate portion 52.

It is an important feature of the tool 10 that the extension members 54, 56 and intermediate portion 52 are circumferentially continuous and integrally formed. Among the benefits received from such construction are that the intermediate portion 52 is uniformly radially extended by the extension members 54, 56, the seal support surfaces 68 completely circumferentially contact the casing 12, thereby completely eliminating any extrusion gap therebetween when the intermediate portion engages the casing, the seals 58, upper or lower extension member, intermediate portion and the seal 50 form a continuous barrier to fluid flow between the mandrel 14 and casing, etc. Additionally, the integral construction of the upper and lower end portions 46, 48, extension members 54, 56 and intermediate portion 52 reduces the number of components required for a packing assembly on the tool 10.

Note that when the tool 10 is set in the casing 12 as representatively illustrated in FIG. 1B, an internal annulus 70 formed between the mandrel 14 and the extension assembly 16 is exposed to fluid pressure in a lower annulus 72 formed between the tool 10 and the casing 12 below the seal 50. If fluid pressure in the annulus 70 is greater than fluid pressure in an upper annulus 74 formed between the tool 10 and the casing 12 above the seal 50, this pressure differential may act to enhance the engagement of the extension assembly 16 with the casing by further radially outwardly urging the intermediate portion 52. If, however, this result is not desired, the seals 58 may be positioned adjacent the lower end portion 48 to prevent fluid communication between the annulus 70 and the lower annulus 72 and provide fluid communication between the annulus 70 and the upper annulus 74.

When the tool 10 is set in the casing 12, the intermediate portion 52 is bowed outwardly by the extension members 54, 56. This may be clearly seen in FIG. 1C, an enlarged view taken of the intermediate portion 52 shown in FIG. 1B. Such outward bowing of the intermediate portion 52 causes the recess 66 to outwardly bow therewith, enhanced in part in that the recess 66 is positioned centrally on the intermediate portion, and the intermediate portion has a reduced cross-sectional area due to the recess. Thus, it will be readily appreciated that outward bowing of the intermediate portion 52 may be varied, or eliminated, by selective positioning of the recess 66, by varying the depth and width of the recess, by varying the cross-sectional thickness of the intermediate portion 52, etc.

It is to be understood that it is not necessary for the intermediate portion 52 to outwardly bow when the tool 10 is set in the casing 12. Where, however, the seal 50 is initially recessed relative to the seal support surfaces 68 as shown in FIG. 1A, such outward bowing of the intermediate portion 52 is useful in radially outwardly urging the seal 50 into sealing engagement with the casing 12. Of course, if the seal 50 is not initially recessed relative to the seal support surfaces 68, such outward bowing may not be needed or desired, in which case the outward bowing may be reduced or eliminated as described above.

The extension members 54, 56 are depicted in FIGS. 1A–1C as having substantially equivalent cross-sectional thicknesses as the intermediate portion 52 (other than at the recess 66), and the integral attachments of the extension members to the end portions 46, 48 and to the intermediate portion. It will be readily appreciated that the compressive force needed to axially compress the extension assembly 16 may be varied by making corresponding changes to these cross-sectional thicknesses. For example, the cross-sectional thickness at the attachment of each extension member 54, 56 to its respective end portion 46 or 48 may be reduced, and/or the cross-sectional thickness at the attachment of each extension member to the intermediate portion 52 may be reduced to correspondingly reduce the compressive force required to axially compress the extension assembly. As another example, the cross-sectional thicknesses of one or both of the extension members 54, 56 may be reduced to likewise produce a reduction in the required compressive force. Conversely, such thicknesses, or any combination of them, may be increased to produce an increase in the required compressive force.

Thus, the compressive force required to axially compress the extension assembly 16 may be adjusted as desired by making corresponding adjustments in the cross-sectional thickness of one or more of the extension assembly components and attachments between the components. It will be readily appreciated that other changes in the geometries of the extension members 54, 56 may be made to adjust the compressive force required to axially compress the extension assembly 16, and that such adjustments may also be made by changing materials, heat treatment, attachments, etc. of the extension members or other elements of the tool 10.

Although the extension assembly 16 has been shown and described as being substantially integrally formed, with the exceptions of the seals 50, 58, it is to be clearly understood that each of the components of the extension assembly may be separately formed from the other components and then attached using, for example, threads, couplings, pins, screws, welding, or any other attachment method. Additionally, other components may be interconnected between the depicted components as desired. For example, a coupling (not shown) having a moment of inertia and/or modulus of elasticity less than that of the extension members 54, 56 and/or intermediate portion 52 may be interconnected between each of the extension members and the intermediate portion 52 to thereby reduce the compressive force required to axially compress the extension assembly 16. Conversely, such a component having a moment of inertia and/or modulus of elasticity greater than that of the extension members 54, 56 and/or intermediate portion 52 may be used to increase the required compressive force. Thus, it will be readily appreciated by a person of ordinary skill in the art that components interconnected between one or more of the depicted extension assembly 16 components may be utilized to alter the compressive force required to axially compress the extension assembly.

The tool 10 is shown in FIGS. 1A–1C having a single extension assembly 16 disposed-on the mandrel 14 between the lower gauge ring sub 60 and the force transmitting assembly 18. However, it will be readily appreciated that, with the mandrel 14 axially extended, a second extension assembly 16 could be disposed on the mandrel between the lower gauge ring sub 60 and the force transmitting assembly 18. Of course, one or both of the first and second extension assemblies 16 would need to be appropriately modified for attachment therebetween, such as by providing internal threads similar to threads 62 at the upper end of the second extension assembly. In this manner, with an appropriately configured mandrel 14 and associated extension assemblies 16, the tool 10 may be considered modular.

Figure 2:
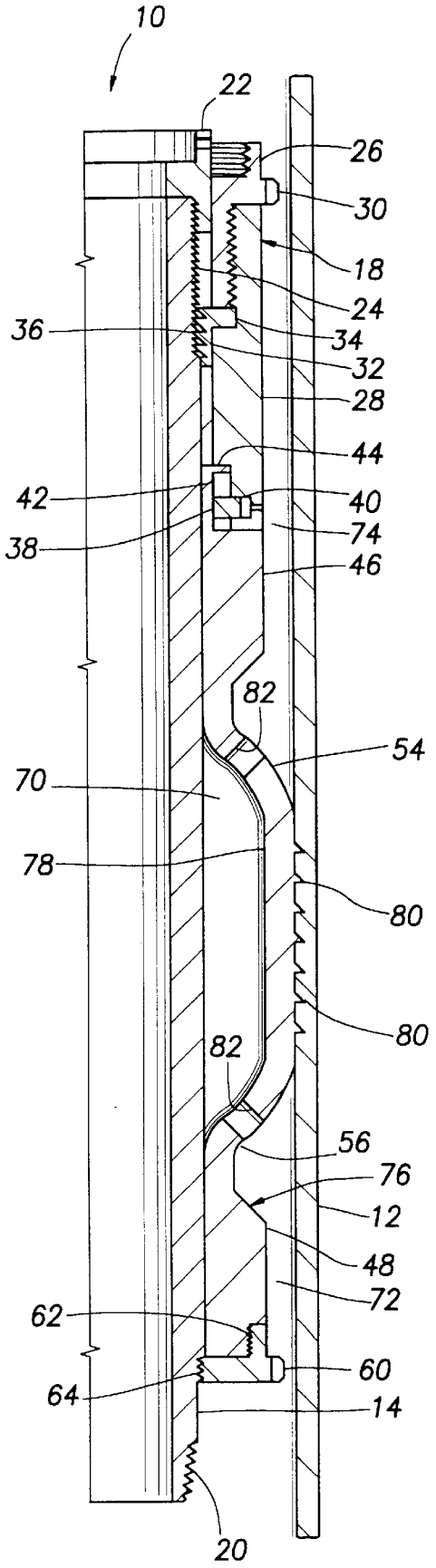
FIG. 2 is a quarter-sectional view of a second tool embodying principles of the present invention, the tool being shown in a configuration in which it is set in a tubular member in a well.

Referring additionally now to FIG. 2, the tool 10 is shown with a differently configured extension assembly 76, in place of the extension assembly 16 described above, disposed on a somewhat lengthened mandrel 14. The extension assembly 76 is configured for gripping engagement with the casing 12. For this purpose, the extension assembly 76 includes an intermediate portion 78 having a series of axially spaced apart and circumferentially extending teeth 80 formed externally thereon. Of course, other gripping structures or grip members may be formed on, or otherwise attached to, the intermediate portion 78 without departing from the principles of the present invention. For example, the teeth 80 may be threads.

As representatively depicted in FIG. 2, each of the teeth 80 has a downwardly inclined face. The teeth 80 are thus configured for resisting axially downwardly directed forces applied to the tool 10, for example, due to the weight of a tubing string attached to threads 20 of the mandrel 14 as described above. Therefore, the tool 10 configured as shown in FIG. 2 is usable as a tubing hanger. However, it will be readily appreciated by a person of ordinary skill in the art that the teeth 80 or other gripping members may be configured to additionally, or alternatively, resist upwardly directed forces applied to the tool 10. For example, each of the teeth 80 could be configured to have an upwardly inclined face. Thus, the teeth 80 or other gripping structure may be configured to grip the casing 12 and resist displacement of the tool 10 relative to the casing in any direction or combination of directions without departing from the principles of the present invention.

The tool 10 as shown in FIG. 2 is configured for gripping engagement with the casing 12, but not for sealing engagement with the casing, although it will be readily appreciated that the teeth 80 could sealingly engage the casing, due to the fact that the teeth are circumferentially continuous. Since the extension assembly 76 is not configured for sealing engagement, it does not include the seals 58 carried on the interior of the upper end portion 46. Additionally, ports 82 are formed through the extension members 54, 56 to permit relatively unobstructed flow of fluid between the annulus 70 and each of the upper annulus 74 and lower annulus 72. However, it is to be clearly understood that, if it is desired for the tool 10 to both grippingly and sealingly engage the casing 12, the extension assembly 78 could easily be provided with seals, such as seals 58, for sealing engagement with the mandrel 14, and the extension members 54, 56 could be formed without the ports 82, without departing from the principles of the present invention.

Figure 3:
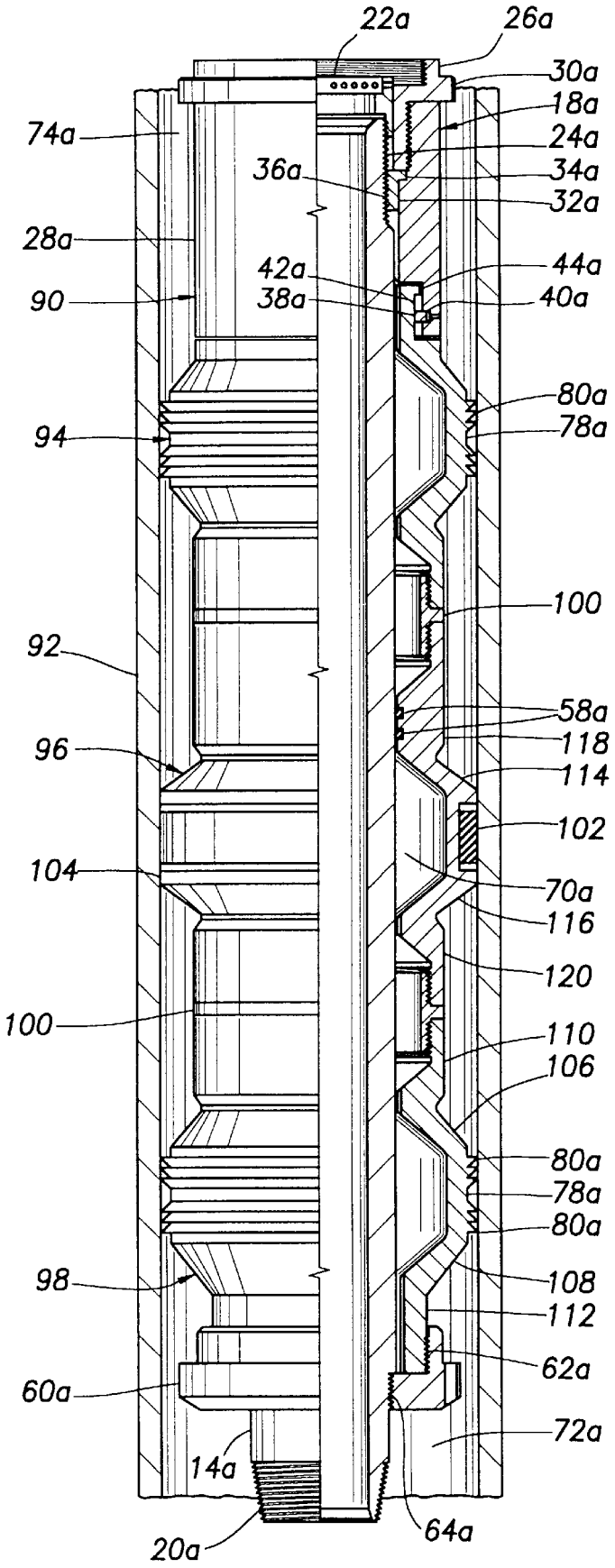
FIG. 3 is a partially elevational and partially cross-sectional view of a third tool embodying principles of the present invention, the tool being shown in a configuration in which it is set in a tubular member in a well.

Referring additionally now to FIG. 3, a tool 90 embodying principles of the present invention is representatively illustrated set in casing 92 or another tubular member in a well. Elements shown in FIG. 3 which are similar to those previously described are indicated using the same reference number, with an added suffix "a".

The tool 90 includes three extension assemblies 94, 96, 98 disposed on the mandrel 14*a*, which has been lengthened accordingly, as compared to the mandrel 14 shown in FIG. 2. Thus, it may be seen that any number of extension assemblies may be provided in a tool constructed according to the principles of the present invention.

The upper extension assembly 94 is configured somewhat similar to the extension assembly 76 shown in FIG. 2. The extension assembly 94 includes an intermediate portion 78*a* having teeth 80*a* externally formed thereon. However, some of the teeth 80*a* have upwardly inclined faces, and some of the teeth have downwardly inclined faces. The teeth 80*a* are, therefore, configured for resisting both upwardly and downwardly directed forces applied to the tool 90.

The upper extension assembly 94 is threadedly attached to the middle extension assembly 96 via a coupling 100. The coupling 100 is externally threaded at its ends for attachment to internally threaded ends of the upper and middle extension assemblies 94, 96. Of course, the upper extension assembly 94 could easily be directly threadedly attached to the middle extension assembly 96, and could be otherwise attached thereto, without departing from the principles of the present invention.

The middle extension assembly 96 is configured for sealing engagement with the casing 92. It includes the internal seals 58*a* for sealing engagement with the mandrel 14*a*, and an external circumferential seal 102. Note that an intermediate portion 104 of the extension assembly 96 is not outwardly bowed, although the intermediate portion could outwardly bow without departing from the principles of the present invention. Also note that the seal 102 is provided with backup rings, but such backup rings are not necessary.

The lower extension assembly 98 is coupled to the middle extension assembly 96 using another coupling 100. The lower extension 98 is somewhat similar to the upper extension assembly 94 in that it is configured for gripping engagement with the casing 92. Thus, the lower extension assembly 98 includes the teeth 80*a* formed on the intermediate portion 78*a*. However, the lower extension assembly 98 is also configured for threaded attachment to the lower gauge ring sub 60*a* and, therefore, has threads externally formed on its lower end. Of course, the lower extension assembly 98 may alternatively be configured with internal threads on its lower end for threaded attachment to an externally threaded lower gauge ring sub 60*a*.

Configured as shown in FIG. 3, the tool 90 might be referred to as a "packer", since it both grippingly and sealingly engages the casing 92. In a tool which both seals to, and anchors to, a tubular member in a well, such as a packer, it is generally considered desirable to anchor the tool to the tubular member before sealing the tool to the tubular member, so that no displacement of the tool occurs thereafter which might tear abrade, cut, or otherwise damage the seal members. If the tool is configured to grippingly engage the tubular member both above and below the sealing members, it is generally considered desirable to anchor the tool to the tubular member on one side of the sealing members, then sealingly engage the tool with the tubular members, and then anchor the tool to the tubular member on the other side of the sealing members.

Since the tool 90 as representatively depicted in FIG. 3 is configured to grippingly engage the casing 92 on either side of the seal 102, the lower extension assembly 98 is designed to axially compress and radially outwardly extend its intermediate portion 78*a* into gripping engagement with the casing 92 before such axial compression and radial extension of the middle extension assembly 96, and the middle extension assembly is designed to axially compress and radially outwardly extend its intermediate portion 104 into sealing engagement with the casing before such axial compression and radial extension of the upper extension assembly 94. However, it is to be clearly understood that the above described sequence of setting the tool 90 in the casing 92 is not necessary in a tool constructed in accordance with the principles of the present invention. For example, the extension assemblies 94, 96, 98 could be configured to simultaneously axially compress and radially extend, any one or any combination of the extension assemblies could be configured to axially compress and radially extend before the other ones of them, etc.

In order to ensure that the lower extension assembly 98 will axially compress before the other extension assemblies 94, 96, extension members 106, 108 are made less resistant to bending at their attachments to upper and lower to end portions 110, 112 and at their attachments to the intermediate portion 78*a*. It will, of course, be readily apparent to one of ordinary skill in the art that other ways of making the lower extension assembly 98 less resistant to axial compression may be used, such as using material less resistant to bending, lengthening the moment arm which acts to outwardly extend the intermediate is portion 78*a*, reducing the cross-sections of one or both of the extension members 106, 108 or their attachments to the upper and/or lower end portions 110, 112, etc.

Similar measures, or others, may be taken to ensure that the middle extension assembly 96 is axially compressed after the lower extension assembly 98, but before the upper extension assembly 94. For example, note that a cross-sectional thickness of each of extension members 114, 116 is reduced at its attachment to respective upper and lower end portions 118, 120. In this manner, the middle extension assembly 96 is made to bend more easily at the attachments of the extension members 114, 116 to the respective upper and lower end portions 118, 120, than at the attachments of the extension members to the intermediate portion 104.

Figure 4:
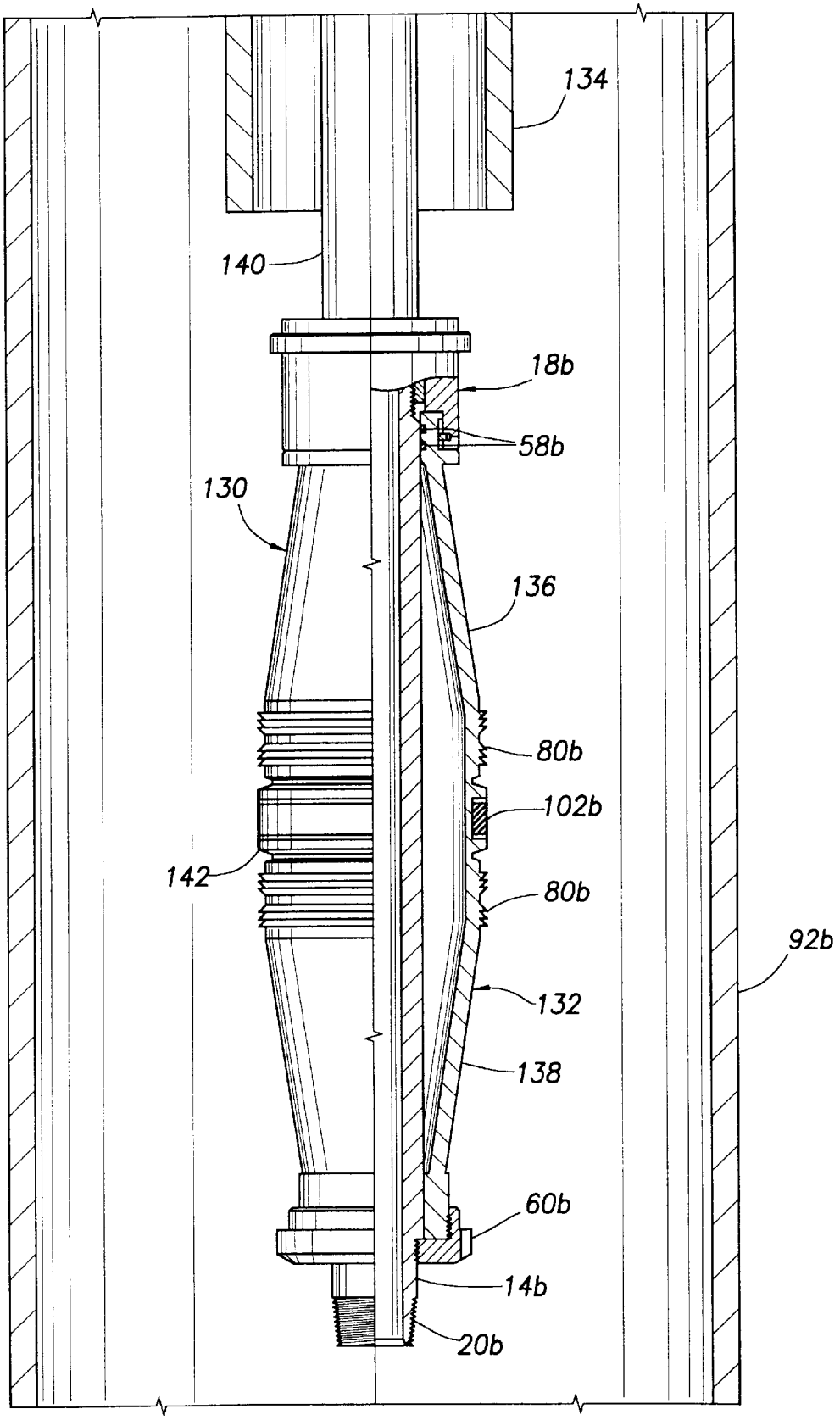
FIG. 4 is a partially elevational and partially cross-sectional view of a fourth tool embodying principles of the present invention, the tool being shown in a configuration in which it is conveyed through a relatively small diameter tubular member prior to being set within another relatively large diameter tubular member.

Referring additionally now to FIG. 4, a tool 130 embodying principles of the present invention is representatively illustrated. Elements shown in FIG. 4 which are similar to elements previously described are indicated in FIG. 4, with an added suffix "b".

The tool 130 illustrates that an extension assembly 132 may be provided on a tool constructed in accordance with the principles of the present invention, which performs more than one function. For example, the extension assembly 132 of the tool 130 is provided with both teeth 80*b* for grippingly engaging the casing 92*b*, and with seal 102*b* for sealingly engaging the casing. Note that the extension assembly 132 is depicted as being integrally formed, but that the teeth 80*b* and seal 102*b* may be provided on separate portions attached to each other, so that the extension assembly is modular.

The tool 130 also illustrates the unique capability of a tool constructed in accordance with the principles of the present invention for use in slim hole environments. Note that the tool 130 has been conveyed into the casing 92*b* through another tubular member, a tubing string 134. Thus, the tool 130 must have a diameter small enough to pass easily through the tubing string 134, yet have the capability to radially outwardly extend sufficiently far to grippingly and sealingly engage the casing 92*b*.

In order to accomplish these objectives, the tool 130 is provided with lengthened extension members 136, 138. Therefore, when an axially compressive force is applied to the extension assembly 132 by, for example, a conventional setting/retrieval tool 140 attached to the tool 130 as described above, the lengthened extension members 136, 138 will force an intermediate portion 142 of the extension assembly a comparatively large radial distance outward from the mandrel 14*b*.

Thus have been described the tools 10, 90 and 130 which close off extrusion gaps, permit increased radial clearances between the tools and tubular members in which they are installed, permit increased radial extension for gripping and sealing engagement with tubular members, are compact, require relatively few components, are conveniently retrievable, are easily millable, and which may include circumferentially continuous gripping members for uniform gripping engagement with tubular members. In particular, the tools 10, 90, 130 are versatile enough to permit their use in a wide variety of casing sizes and weights, thereby reducing costs of designing, testing, warehousing, etc. many different sizes of tools.

Of course, a person of ordinary skill in the art would find it obvious to make modifications, additions, deletions, substitutions, and other changes to the various embodiments of the invention representatively illustrated and described herein. Accordingly, the foregoing detailed description is to be clearly understood as being given by way of illustration and example only, the spirit and scope of the present invention being limited solely by the appended claims.

What is claimed is:

1. A device operatively positionable within a subterranean well for anchoring a generally tubular mandrel to an inner side surface of a tubular member disposed within the well, the apparatus comprising:

a grip member configured for grippingly engaging the inner side surface;

an annular grip portion having an inner diameter and an outer side surface, the grip member being attached to the outer side surface;

first and second end portions; and first and second extension members, the first extension member being interconnected between the grip portion and the first end portion, and the second extension member being interconnected between the grip portion and the second end portion, the first extension member axially and radially spacing the grip portion away from the first end portion, and the second extension member axially and radially spacing the grip portion away from the second end portion.

2. The device according to claim 1, wherein the grip portion, first and second end portions, and first and second extension members are integrally formed.

3. The device according to claim 1, wherein each of the first and second end portions has an inner diameter which is less than the grip portion inner diameter.

4. The device according to claim 1, wherein each of the first and second extension members has a curved shape.

5. The device according to claim 1, wherein each of the first and second extension members has a substantially linear shape.

6. The device according to claim 1, further comprising an annular seal carrying portion interconnected to the grip portion, the seal carrying portion carrying a seal in an external annular recess formed on the seal carrying portion.

7. The device according to claim 6, wherein the grip portion and the seal carrying portion are integrally formed.

8. A device for grippingly engaging a tubular member disposed in a well, the device comprising:

a mandrel having an outer wall and a longitudinal bore therethrough; and a gripping assembly disposed about the mandrel, the gripping assembly including a gripping surface, first and second opposite ends, and first and second extension portions, each of the first and second extension portions coupling the gripping surface to a respective one of the first and second ends.

9. The device according to claim 8, wherein the gripping surface includes a series of spaced apart teeth formed thereon.

10. The device according to claim 8, wherein the second end is secured to the mandrel.

11. The device according to claim 10, wherein the first end is slidingly disposed relative to the mandrel.

12. The device according to claim 8, wherein each of the first and second extension portions is generally tubular-shaped and has a first circumference at its coupling to the gripping surface which is larger than a second circumference at its coupling to the respective one of the first and second ends.

13. The device according to claim 8, wherein the gripping surface, first and second extension portions, and first and second ends are integrally formed.

14. The device according to claim 8, further comprising a compression member disposed relative to the mandrel, the compression member being displaceable relative to the mandrel in a first direction, and the gripping assembly being longitudinally compressed when the compression member is displaced in the first direction.

15. The device according to claim 14, wherein the gripping surface is radially outwardly extended when the compression member is displaced in the first direction.

16. The device according to claim 14, wherein the gripping surface is radially inwardly retracted when the compression member is displaced in a second direction relative to the mandrel.

17. The device according to claim 8, further comprising a compression member slidingly disposed relative to the mandrel in first and second opposite directions, the gripping surface being radially outwardly extended when the compression member is displaced in the first direction, and the gripping surface being radially inwardly retracted when the compression member is displaced in the second direction.

18. The device according to claim 17, wherein the compression member is coupled to the gripping assembly first end.

19. The device according to claim 17, wherein the compression member is releasably secured to the gripping assembly.

20. The device according to claim 17, further comprising a slip member, the slip member permitting displacement of the compression member in the first direction and preventing displacement of the compression member in the second direction.

21. The device according to claim 20, wherein the slip member is releasably secured relative to the compression member, the slip member permitting displacement of the compression member in the second direction when the slip member is released from securement relative to the compression member.

22. The device according to claim 20, wherein the slip member is axially slidingly disposed relative to the mandrel, the slip member grippingly engaging the mandrel when a force is applied thereto in the second direction.

23. The device according to claim 22, wherein the slip member is generally annular-shaped and internally toothed.

24. The device according to claim 17, further comprising an annular packing assembly coupled to the gripping assembly.

25. The device according to claim 24, wherein the packing assembly includes first and second seal member support surfaces, an annular recess disposed between the first and second support surfaces, a circumferential seal member disposed in the recess, third and fourth opposite ends, and third and fourth extension portions, each of the third and fourth extension portions coupling a respective one of the first and second support surfaces to a respective one of the third and fourth ends.

26. The device according to claim 25, wherein the seal member is radially inwardly recessed relative to the first and second support surfaces.

27. The device according to claim 25, wherein the gripping assembly is sealingly engaged with an outer side surface of the mandrel.

28. The device according to claim 25, wherein the first and second support surfaces are radially inwardly extended when the compression member is displaced in the first direction.

29. The device according to claim 25, wherein the first and second support surfaces are radially inwardly retracted when the compression member is displaced in the second direction.

* * * * *